US005983457A

United States Patent [19]

Toney et al.

[11] Patent Number: 5,983,457

[45] Date of Patent: Nov. 16, 1999

[54] INLET AND OUTLET PLENUM APPARATUS FOR UNIFORM DELIVERY OF FIBER TO A PAD FORMER

[76] Inventors: Jerry L. Toney; Nathan E. E. Toney, both of 4450 Duncan Bridge Rd., Cleveland, Ga. 30528; Gregory F. Ward, 11115 Rotherick Dr., Alpharetta, Ga. 30022

[21] Appl. No.: 09/069,571

[22] Filed: Apr. 29, 1998

[51] Int. Cl.[6] ..... D01G 23/08

[52] U.S. Cl. ..... 19/308; 19/304; 264/121

[58] Field of Search ..... 19/296, 304, 308; 28/101, 117, 118, 103, 105; 264/121; 425/80.1, 81.1, 83.1; 65/476, 505

[56] References Cited

U.S. PATENT DOCUMENTS

| | | | |
|---|---|---|---|
| 1,950,765 | 4/1934 | Winter | 19/144.5 |
| 3,483,051 | 12/1969 | Mesek et al. | 19/308 |
| 3,518,726 | 7/1970 | Banks | 19/144.5 |
| 3,599,293 | 8/1971 | Nystrand et al. | 19/155 |
| 3,727,270 | 4/1973 | Marshall | 19/304 |
| 3,846,871 | 11/1974 | Kolbach | 19/148 |
| 3,857,657 | 12/1974 | Teed | 28/115 |
| 3,973,291 | 8/1976 | Kolbach | 19/148 |
| 4,005,957 | 2/1977 | Savich | 425/80 |
| 4,153,977 | 5/1979 | Moser | 19/308 |
| 4,388,056 | 6/1983 | Lee et al. | 425/83.1 |
| 4,592,708 | 6/1986 | Feist et al. | 425/80.1 |
| 4,666,647 | 5/1987 | Enloe et al. | 264/121 |
| 4,674,966 | 6/1987 | Johnson et al. | 425/82.1 |
| 4,701,294 | 10/1987 | Radwanski et al. | 264/518 |
| 4,734,957 | 4/1988 | Lenzen | 19/304 |
| 4,904,440 | 2/1990 | Angstadt | 264/517 |
| 5,004,579 | 4/1991 | Wislinski et al. | 264/517 |
| 5,044,052 | 9/1991 | Hertel et al. | 19/308 |
| 5,097,574 | 3/1992 | Hertel et al. | 28/105 |
| 5,302,100 | 4/1994 | Scheu et al. | 425/80 |
| 5,447,677 | 9/1995 | Griffoul et al. | 264/510 |
| 5,455,991 | 10/1995 | Long et al. | 19/304 |

*Primary Examiner*—Amy B. Vanatta

[57] ABSTRACT

The present invention provides an inlet and outlet plenum apparatus for improving the forming of fibrous pads for absorbent products and providing improved density control. Fibers entrained in a high speed air flow coming from a fiberizer or other fiber source enter an inlet plenum which reduces velocity by increasing the area of the inlet plenum in a linear manner thereby decreasing turbulence and improving the density distribution of the fiber deposited onto the foraminous surface of a pad-former screen. The outlet plenum allows for a controlled velocity increase which reduces under-screen turbulence and further improves fiber distribution and density control.

7 Claims, 2 Drawing Sheets

INLET AND OUTLET PLENUM APPARATUS FOR UNIFORM DELIVERY OF FIBER TO A PAD FORMER

FIELD OF THE INVENTION

The present invention relates to an inlet plenum apparatus for delivering a uniform mass of air-borne cellulose or other fibers, natural and synthetic including all forms of superabsorbent, used for absorbent applications such as disposable diapers and the like, to an apparatus employing a rotating drum containing a foraminous pad forming system, depositing it on the pad forming system in a uniform layer as required by the pad former design and the outlet plenum apparatus for exhausting the spent air.

BACKGROUND AND SUMMARY OF THE INVENTION

This invention relates to a novel apparatus for depositing the air-borne cellulose or other fibers, including all forms of superabsorbent and wicking fibers, into foraminous forming pockets to form a fibrous pad. Prior art patents have demonstrated the importance of various methods of providing the fiber-air mixture to the foraminous forming pockets. U.S. Pat. No. 5,097,574 to Hertel et al. discloses the use of a reverse bend section in the fiber delivery duct which design intensifies the fiber stream to achieve particle deposition on the screen without substantial turbulence. U.S. Pat. No. 5,44,052 to Hertel et al. discloses the use of ducts that are characterized by reverse bends in order to densify the particle stream at the outside of the curvature for generally perpendicular deposition on the screen.

A major weakness in much of the art is the high pressure drops between the intake and outlet plenums as well as disturbances in air flow due to non-symmetrical placement of the exhaust from the low pressure plenum. A large body of art exists showing pad formers with the individual pockets having up to 8 layers of wire mesh, masks, and perforated plates which creates significant pressure drops across the forming section as well as highly turbulent areas above and below the forming section. Since the absorbent pads of today, especially in infant diapers are as much as 65% lighter than equivalent products of twenty years ago, due to the use of superabsorbents, uniform fiber formation and density are extremely important to the successful operation of pad formers.

It is well known in the patent art that in order to obtain good pad integrity it is necessary to have a high air flow through the pad during forming sequence. However, the large volume of air produces air turbulence and instability especially at the ends and edges of the forming pocket, consequently fiber distribution problems will occur. These instabilities are usually seen as eddies or pulsing at the perimeter of the foraminous forming pockets. This is especially bad when high differential pressures are created over the forming screen interface. This can be caused by excessively high inlet and outlet velocities, excessive under-screen masks and multiple layers of screens and other equipment.

Additional problems typically encountered due to uneven or turbulent flow entering the forming screen are uneven fiber density in the formed pad and clumping due to scarfing of the pad by high velocity air tangent to the screen.

After considerable investigation into the aerodynamics of the inlet and plenum we discovered that a significant slowing of the airflow from the conveying line into the forming area by a specified amount induced by a specific shaping of the inlet plenum resulted in improved uniformity of the pad. Additionally it was discovered that shaping the outlet or low pressure plenum in a specific way such that the airflow was gradually increased from the velocity at the screen surface to a specific range of velocities related to the area ratios of the inlet to outlet of the outlet plenum resulted in further improvement in pad density uniformity. It was also noted that the longer the effective length of the outlet plenum the more uniform was the fiber distribution.

This work was conducted using a rectangular pad designed for constant thickness from end to end and side to side to simplify the measurement of density variations. Limited work with pads having a shaped cross section indicated that end to end densities were uniform at given distances from the centerline of the pad.

In evaluations of competitive equipment before modification with low differential pressure plenums it was determined that the pressure profile across the width of the drum below the inner diameter of the drum had significant variations due to problems with the internal low pressure side design. This resulted in variations in fiber density and the amount or weight of fiber per square inch across the pad width and length. Use of the low differential pressure plenums resulted in reduced turbulence and improved pad density uniformity. It is important to note that the length of the outlet plenum provides a smooth transition back to high speed flow thus preventing the occurrence of eddies and turbulence on the inlet side of the forming screens. This results in a relatively even pressure distribution at all points on the forming screen. As mentioned above the experiments were carried out on a rectangular constant density absorbent product. However when the apparatus was used with shaped pads the uniformity was also excellent.

In another embodiment a superabsorbent doing tube is inserted through the intake plenum for delivery of superabsorbent. Tube placement is dependent on the anticipated placement of the superabsorbent in the pad.

These unexpected results are highly important in the modern absorbent pad where thinner pads are the rule. If the density and formation cannot be closely controlled the pad will break and not perform correctly.

It should be recognized that the instant concept is not limited to drum formers but can be adapted to other former configurations including linear endless "belt" systems.

BRIEF DESCRIPTION OF THE DRAWINGS

The invention is described in conjunction with an illustrative embodiment in the accompanying drawings in which.

DETAILED DESCRIPTION OF THE INVENTION

Figure 1:
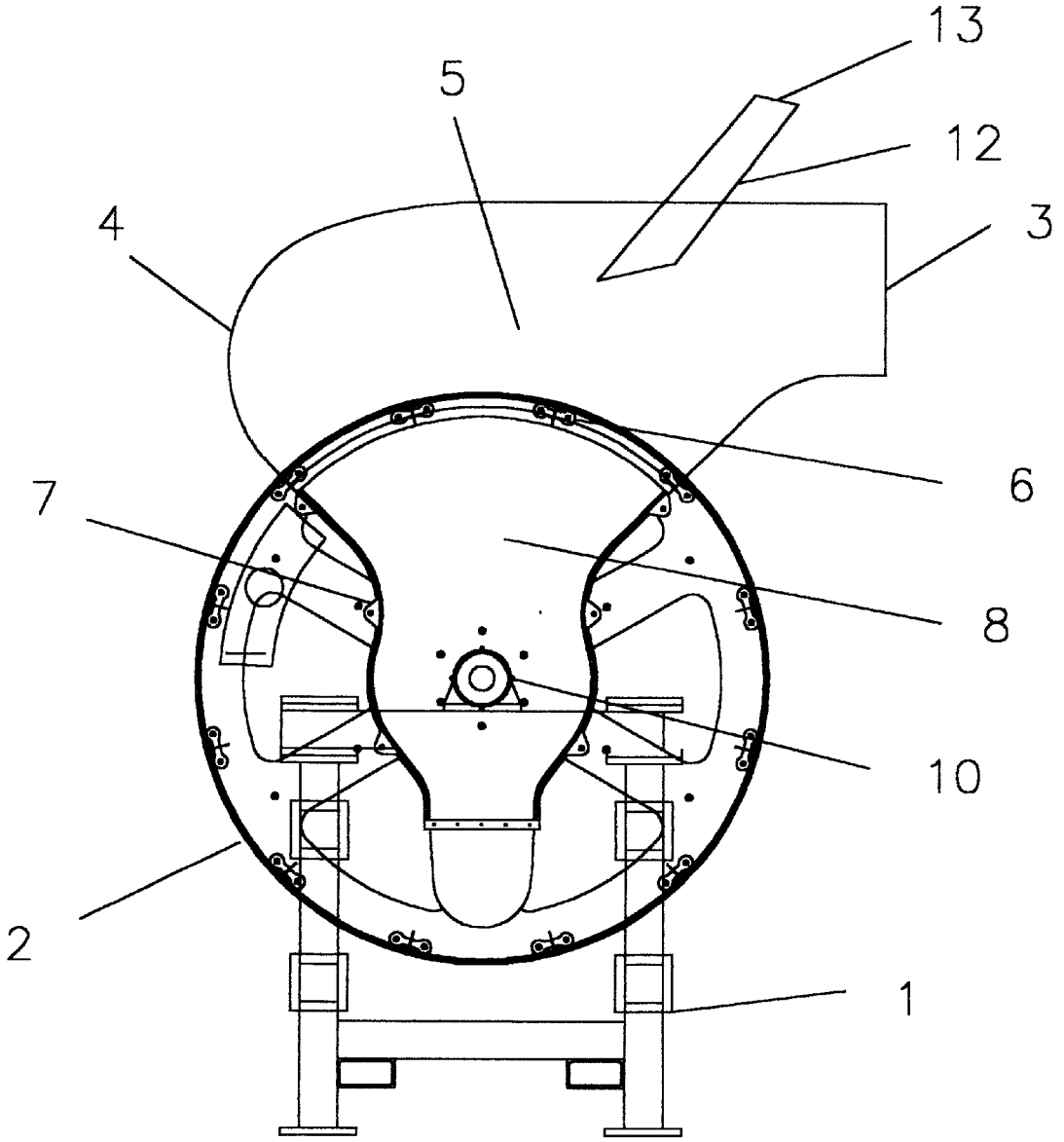
FIG. 1 is a side elevational view of apparatus employed in the practice of the invention and illustrates the shape of the inlet and outlet plenums.

Referring to the drawings, FIG. 1 shows the pad former frame 1, and the drum assembly 2 which is mounted on the driven shaft 10. A high velocity air duct is attached to inlet port 3 which feeds an air stream containing between 0.006 to 0.04 pounds of fiber per cubic foot to the plenum structure 4 which encloses the inlet plenum 5 which is constructed such that the ratio of the inlet area to the drum surface area 6 enclosed by the plenum ranges from about 1.8 to about 3.5 with a preferred ratio of about 2.5. The plenum is constructed such that the expansion of the area from inlet to screen is approximately linear. This results in a uniform decrease in velocity such that turbulence is reduced and the fibers are deposited uniformly on the screen surface. Further experimentation showed that there is also improvement in pad formation when the expansion of the area from inlet to screen follows an exponential function.

FIG. 1 also shows a superabsorbent dosing inlet line 12 which is supplied with an air borne mixture of fiber and superabsorbent or pure superabsorbent fibers, granules or other particulate form through port 13. The outlet of the dosing line is placed between 0.5 and 15 inches from the outer surface of the drum assembly 2 and has a width ranging from about 5% to about 90% of the width of the forming pocket.

Figure 2:
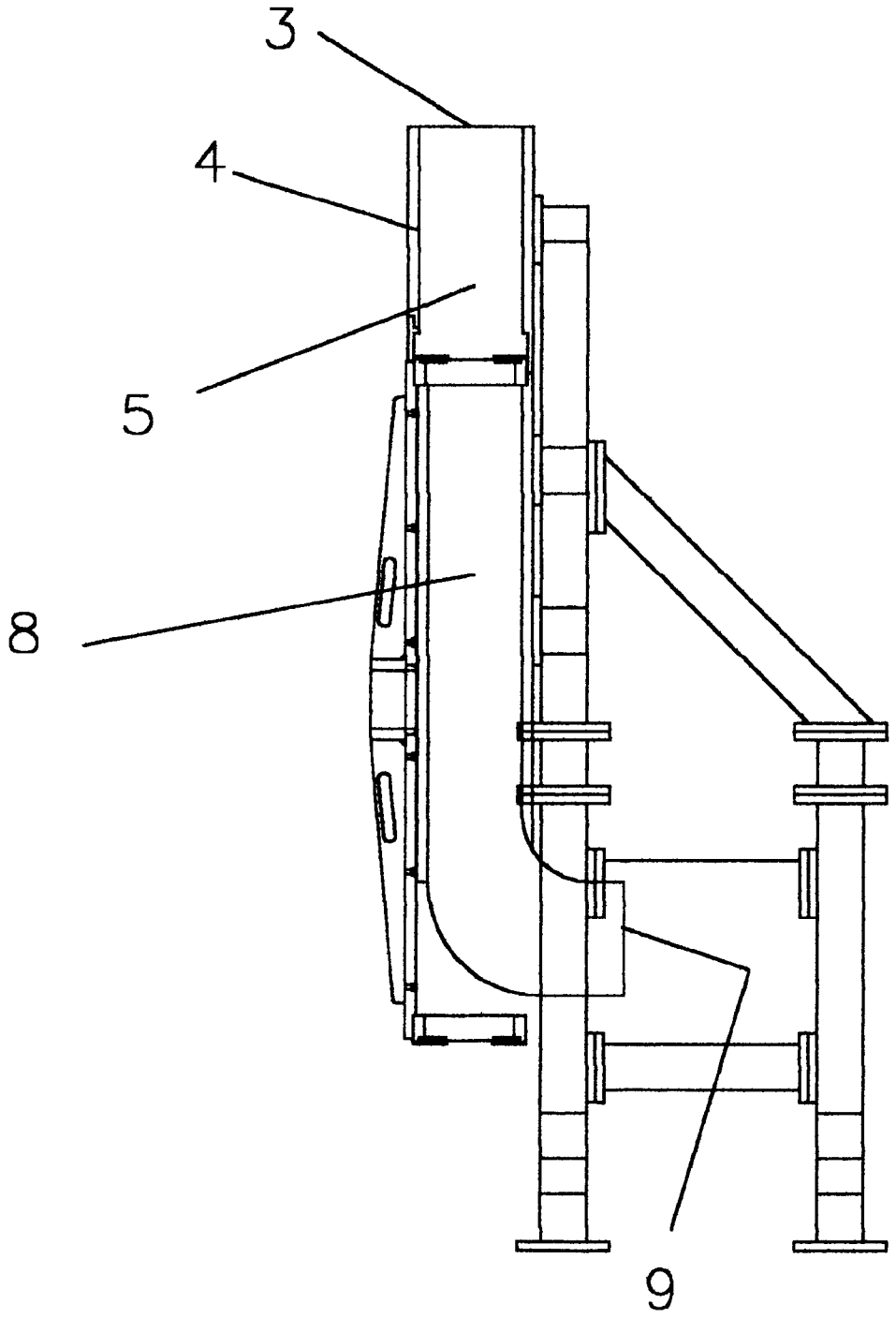
FIG. 2 is an end elevational view of the apparatus of FIG. 1 but without the superabsorbent dosing line.

After the fiber is deposited on the screen at 6 the air is exhausted through the outlet plenum 8 which is formed by the structure 7. The plenum 8 extends around the drive shaft keeping the plenum area uniform and preventing that area from containing a sudden contracting-expanding section that would cause airflow disruption. The air flows down and out the exit duct 9 of FIG. 2 of the forming drum of the pad former to the source of low pressure that provides control of the velocities and pad densities in the system. The ratio of the outlet area of the drum surface area 6 enclosed by the plenum to the exit duct 9 of FIG. 2 ranges from about 4.0 to about 8.5 with a preferred ratio of about 6. FIG. 1 shows a single inlet that covers ninety degrees of the drum circumference. This is not limiting since the plenum can be designed to cover a larger or smaller portion of the drum former circumference as production requirements dictate. Further it is possible to use multiple plenums to introduce other fibers or superabsorbents or mixtures of fibers and all forms of superabsorbents. This is a unique and novel construction of which is not anticipated nor described in the prior art.

Evaluation of our work including the experiments described below also indicate that the ratio of the inlet plenum ratios to the outlet plenum ratio is also important and ideally should be between about 1.7 and about 2.9.

Experiments

The following experiments were performed to determine the best inlet to outlet ratios for the inlet and outlet plenums.

TABLE 1

| | Inlet Plenum | Outlet Plenum | Pad Density Variation (%) | |
|---|---|---|---|---|
| Experiment # | Ratio | Ratio | Max | Average |
| 1 | 1.5 | 2.0 | 14.5 | 9.0 |
| 2 | 1.8 | 2.5 | 8.7 | 6.1 |
| 3 | 2.5 | 4.0 | 6.3 | 4.4 |
| 4 | 2.5 | 6.0 | 3.5 | 2.2 |
| 5 | 3.0 | 6.0 | 5.3 | 3.6 |
| 6 | 3.5 | 8.5 | 7.1 | 4.9 |
| 7 | 4.5 | 9.5 | 13.9 | 6.7 |

TABLE 2

| | Inlet Plenum | Outlet Plenum | Pad Weight Variation (%) | |
|---|---|---|---|---|
| Experiment # | Ratio | Ratio | Maximum | Average |
| 1 | 1.5 | 2.0 | 12.3 | 8.5 |
| 2 | 1.8 | 2.5 | 8.1 | 5.7 |
| 3 | 2.5 | 4.0 | 5.7 | 3.9 |
| 4 | 2.5 | 6.0 | 2.4 | 1.7 |
| 5 | 3.0 | 6.0 | 4.9 | 3.3 |
| 6 | 3.5 | 8.5 | 6.4 | 4.6 |
| 7 | 4.5 | 9.5 | 11.8 | 6.2 |

Plain rectangular pads were produced to determine the effect of different inlet and outlet ratios. Pads from each experiment were cut into one inch squares. Their weight and density were determined. The average density and weight for each one inch square was calculated. The average and maximum variations of the density and weight were determined as percentages and are included in Tables 1 and 2 above.

This data indicates that the inlet plenum ratio should be between about 1.5 and about 2.7 and is best at about 2.5. This data further indicates that the outlet plenum ratio should be between about 4.0 and about 8.5 and is best at about 6.0.

Having described the invention in detail, it will be readily apparent that various changes and modifications can be made without departing from the essence of this invention. Any such changes and modifications are all contemplated as being within the scope of the present invention as defined by the following claims.

We claim:

1. An apparatus for forming absorbent pads having highly uniform density and weight distributions, said apparatus comprising:

a. an air duct suitable for transporting high velocity air containing cellulose, other fibers, and including all forms of superabsorbent, said duct being attached to an opening of an inlet plenum wherein said plenum expands linearly from the area of said air duct to the area of a drum former surface containing one or more pad forming pockets and bounded by the ends and sides of said plenum which forms an outlet of said inlet plenum such that the ratio of the area of said air duct to the area of said plenum outlet is from about 1.8 to about 3.5, and b. an outlet plenum, wherein said outlet plenum contracts from the area of an inner surface of the drum former containing one or more pad forming pockets and bounded by the ends and sides of said plenum which forms an inlet of said outlet plenum, an outlet area of said outlet plenum which said outlet is connected to an outlet duct of the same area such that the ratio of said inlet plenum area to the area of said outlet plenum is from about 4.0 to about 8.5.

2. The apparatus of claim 1 wherein the outlet plenum extends from the drum former inner surface to at least as far as the bottom of a drive shaft of said drum former.

3. The apparatus of claim 1 wherein the ratio of outlet ratio to the inlet ratio is between about 1.5 and about 2.9.

4. The apparatus of claim 1 wherein the area of the inlet plenum expands exponentially between the inlet and outlet of said inlet plenum.

5. The apparatus of claim 1 wherein the fibers used to form the pad include cellulosic fibers, synthetic fibers, superabsorbent fibers, granules and other particulate forms.

6. The apparatus of claim 1 wherein a superabsorbent dosing means is inserted into the inlet plenum.

7. The apparatus of claim 6 wherein the dosing means includes a dosing line having an outlet, and the outlet of the dosing line is placed between 0.5 and 15 inches from the outer surface of the drum former and has an outlet width ranging from about 5% to about 90% of the width of the forming pocket.

* * * * *